United States Patent [19]

Monaco

[11] 4,257,463

[45] Mar. 24, 1981

[54] COMBINATION CARRYING CASES

[76] Inventor: Rosemarie Monaco, 59-30 108th St., Corona, N.Y. 11368

[21] Appl. No.: 50,292

[22] Filed: Jun. 21, 1979

[51] Int. Cl.[3] ..... A45C 3/02

[52] U.S. Cl. ..... 150/35; 150/1.6; 150/33; 150/28 R

[58] Field of Search ..... 150/34, 35, 33, 28 R, 150/1.6; 190/60, 52

[56] References Cited

U.S. PATENT DOCUMENTS

| | | | |
|---|---|---|---|
| 1,717,295 | 6/1929 | Wolf | 150/33 |
| 2,274,536 | 2/1942 | Doppelt | 150/1.6 |
| 3,122,225 | 2/1964 | Ward | 190/52 |
| 3,696,850 | 10/1972 | Rosenblum | 150/33 |

*Primary Examiner*—Donald F. Norton
*Attorney, Agent, or Firm*—Daniel M. Rosen

[57] ABSTRACT

A combination attache case, handbag, shoulderbag and shoulder-supported attache case, the attache case having carrying handles, a detachable shoulder strap and at least one external pocket for receiving the handbag, the shoulder strap when detached from the attache case being adapted for re-attachment to the handbag which is then usable as a shoulderbag separate and independent of the attache case, this combination including mating fasteners for releasably joining the handbag to the attache case when the handbag is in the attache's external pocket for protection against loss or theft of the handbag.

10 Claims, 8 Drawing Figures

COMBINATION CARRYING CASES

BACKGROUND OF THE INVENTION

This invention is in the field of carrying cases such as attache cases, briefcases, shoulderbags, handbags, clutches and the like typically used by women. The invention is particularly concerned with the modern professional woman who needs to carry a full size attache case for papers associated with her work, and at other times needs to carry only a considerably smaller handbag or shoulderbag for personal items, and often needs to carry both.

The size, shape and weight dimensions of traditional attache cases seem to have evolved for use by businessmen who may be accustomed to carrying larger and heavier luggage, and who usually do not carry an additional handbag or shoulderbag. In recentyears, however, there has been a substantial increase in the proportion of women in professions where it is common or necessary to use an attache case or briefcase. For such women, traditional or standard cases are hardly ideal, for the reasons discussed above, and for the burden or nuisance of carrying a heavy attache case by hand in addition to carrying a handbag or shoulderbag, and lastly because standard attache cases certainly lack any feminine style.

It is an objective of this invention to provide a new attache case, handbag, shoulderbag and shoulder attache case combination that provides a professional woman with four items of luggage in a single attractive and compact but separable combination. An important consideration of this invention is the specific manner of carrying this business luggage by the professional woman. A shoulder strap for the handbag is popular, practical and stylish; a shoulder strap for an attache case is not often used with traditional attache cases, but would be quite practical for anyone with a heavily loaded case and particularly helpful for a woman not wishing to carry the case by its handles.

Merely adding a shoulder strap to an attache case, while being a simple addition, is not necessarily a simple solution if the business woman already has another shoulder strap of her shoulderbag. Using two separate straps is likely to become a nuisance, and the idea of using one strap attached to both the attache case and the shoulderbag is not feasible because the total weight and bulk would be clearly impractical. This approach to this problem has been to develop a new luggage construction that serves the multiple functions of a handbag, shoulderbag, attache case and shoulder attache case, and that has the desirable features of simplicity in manufacture and use, lightweight and high aesthetic appeal.

The new invention has succeeded in satisfying all these objectives as will be described in subsequent sections.

SUMMARY OF THE INVENTION

This invention is a combined attache case, handbag, shoulderbag and shoulder attache case with a shoulder strap that is readily attachable to either the handbag or the attache case for converting either into shoulder luggage. An external pocket is provided in the attache case for easily receiving the handbag which may be opened and used while in the pocket, and is also readily accessible to be gripped and separated from the attache case. Releasable fastener or coupling means are provided for securing the handbag in the attache's pocket to reduce any chance of loss or theft. Additional releasable coupling means are provided on the ends of the strap for quick-release connection to a pair of spaced-apart connection rings on the handbag or a separate pair of similar rings on the attache case. In another external pocket of the attache case is an optional pouch or eyeglass case which may be releasably attached to the attache case by a chain. As an alternative to the shoulder strap, one or more handles are provided on the attache case and optionally on the handbag for maximum convenience and adaptability. Within the attache case are various compartments which may be closed by zipper, spring or snap fasteners or remain open and be freely accessible.

A preferred embodiment of my invention is disclosed and described below with reference to the drawings associated with this application. This preferred embodiment illustrates many important features of the invention, but is only a suggested example of the basic inventive concepts presented herein.

DETAILED DESCRIPTION OF THE PREFERRED EMBODIMENT

Figure 2:
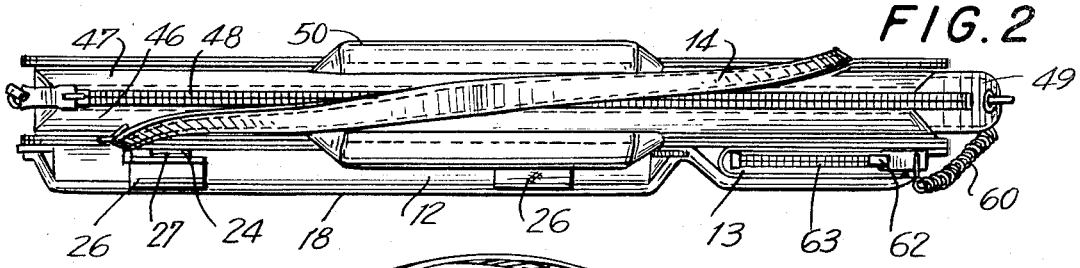
FIG. 2 is a top plan view thereof.

The new invention of a combination attache case is shown in FIGS. 1–5 where the components are releasably secured together as a compact assembly 10. These components, namely the attache case 11, handbag 12, pouch or eyeglass case 13 and shoulder strap 14 have a variety of subcombination constructions for use separately or together and for converting a handbag and attache case into a shoulderbag and shoulder attache case respectively, as will be evident in the following description.

Figure 1:
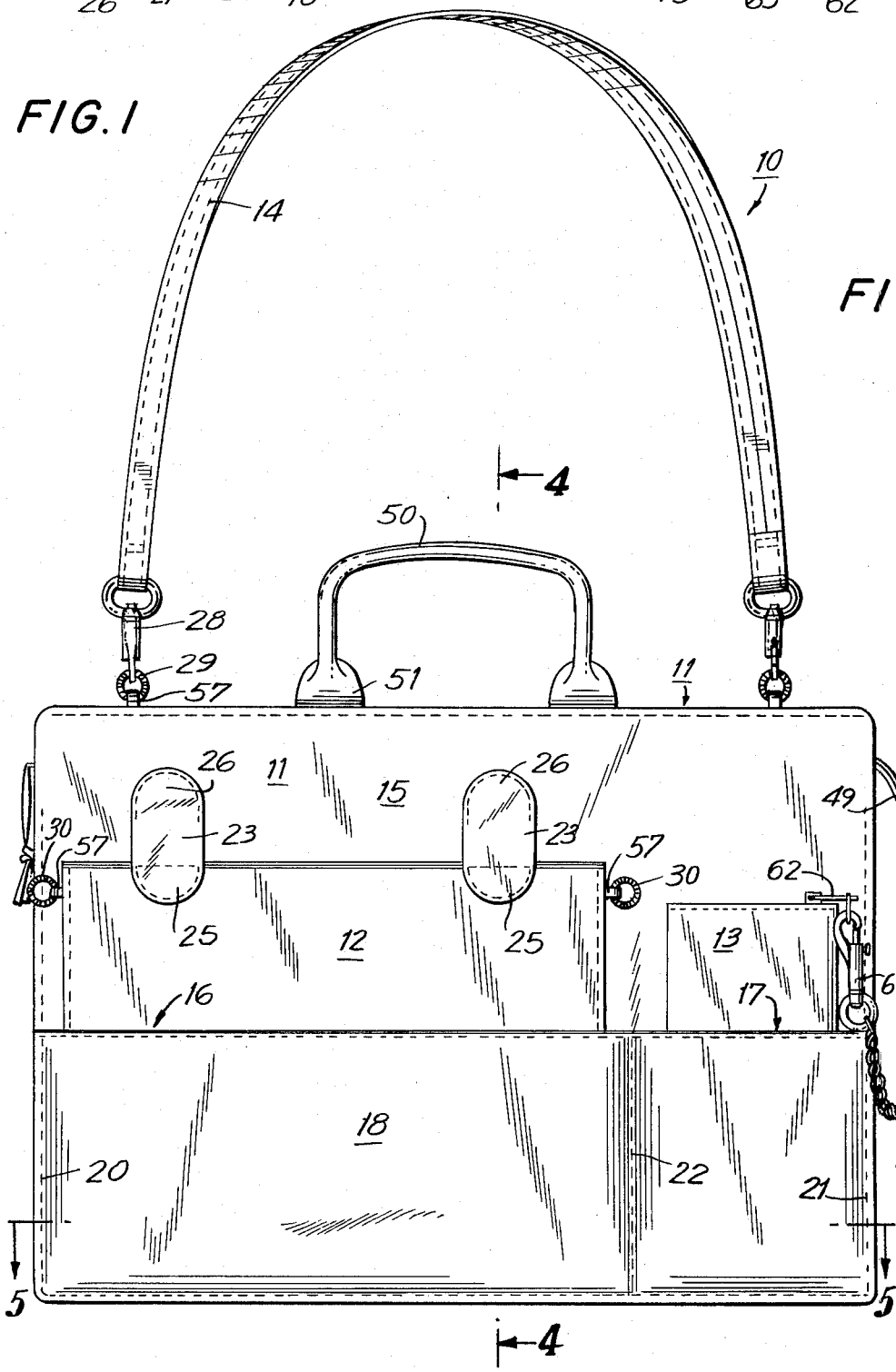
FIG. 1 is front elevation view of the present invention.
Figure 3:
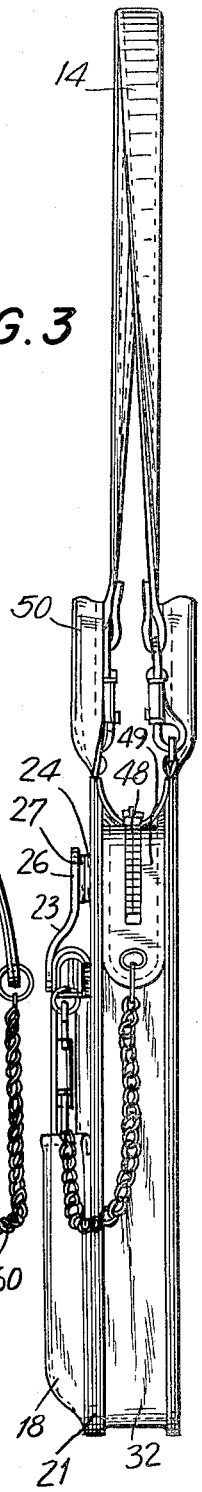
FIG. 3 is a right side elevation view thereof.
Figure 7:
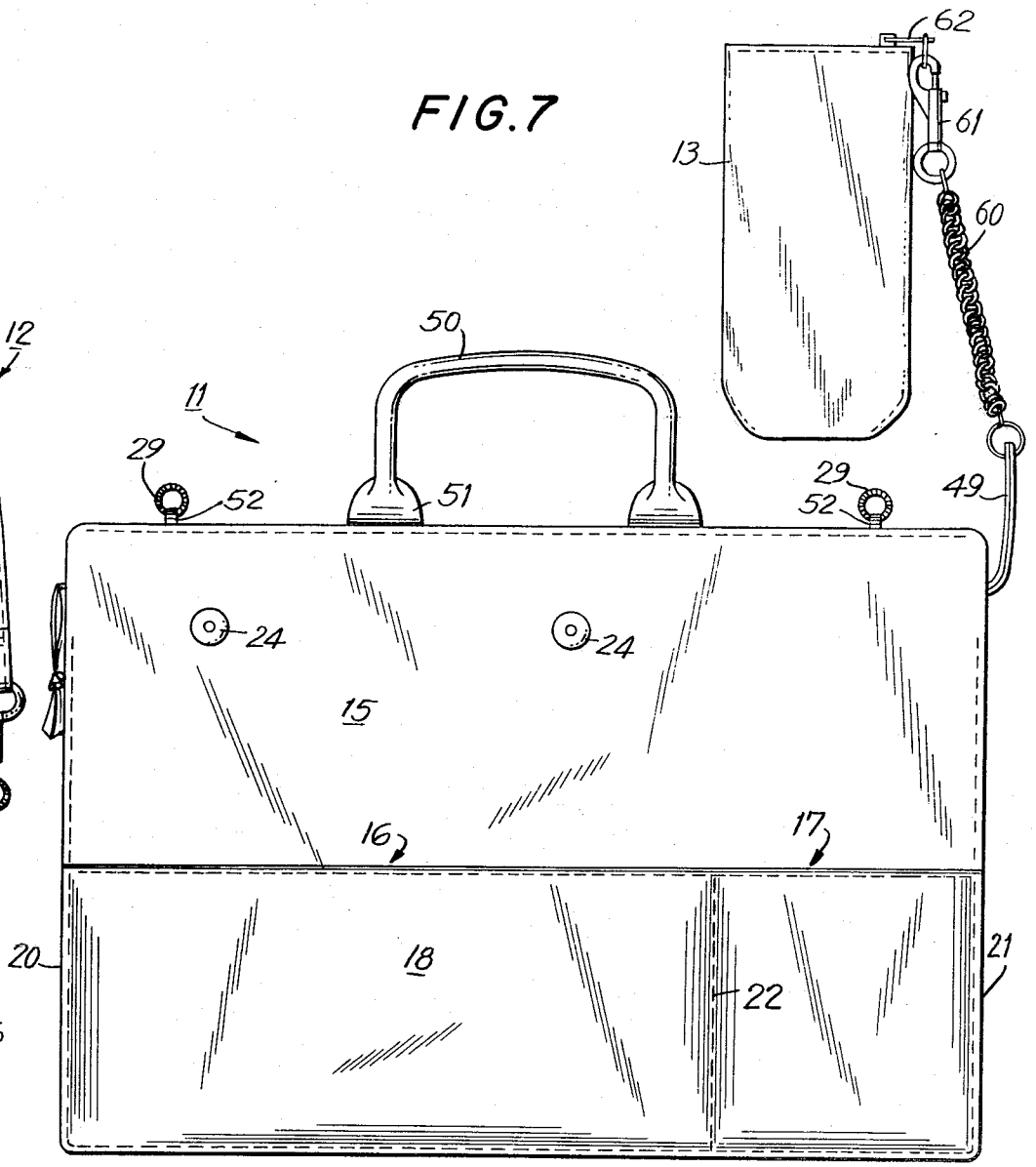
FIG. 7 is a front elevation view of the attache case of FIG. 1 with the handbag and pouch removed from their pockets.

The attache case 11 shown in FIGS. 1 and 7 has on its front wall 15 a large pocket 16 and an adjacent small pocket 17 formed by a strip 18 sewn along its bottom edge 19, opposite end edges 20, 21 and intermediate section 22 to said front wall 15. The larger pocket 16 easily accommodates the handbag 12 as shown in FIGS. 1–3, with the height of the bag 12 somewhat higher than the height of strip 18; accordingly, while the bag may be well contained in the pocket, its upper portion is quite visible and easily grippable when one wishes to remove the bag. This particular attache case and handbag both have length/height ratios of about 1:1.4 which affects an aesthetic balance.

To provide security from accidental loss or theft of the handbag, a pair of locking tabs 23 have been provided for releasably engaging snap fasteners 24 which are permanently fixed to the attache case front wall 15 above pocket 16. Each tab 23 has a lower end 25, seen in FIGS. 1 and 6, sewn to upper edge of handbag 12 and an upper end 26 to which is secured a second snap fastener 27, seen in FIGS. 3 and 4 which may releasably engage with fastener 24. Each tab 23 has an extended position shown in front, side and rear views of the bag in FIGS. 1, 4 and 8 respectively, and a folded position shown in FIG. 6.

When the bag 12 is in pocket 16 and the tabs 23 are in their extended position, the fastener parts 27 and 24 on the tabs and front wall respectively, releasably lock together, to prevent removal of the bag without a noticeable snap that would require the owner's awareness of the incident. The snap results from spring action or other temporary deformation of at least one of the mating fastener members. When the handbag 12 is used as a shoulderbag with the tabs 23 in their folded position of FIG. 6, the fastener part 27 on the rear surface of the tab engages the mating fastener part 27A, shown in FIG. 8, which secures the tabs when not in use and provides a decorative feature.

Figure 6:
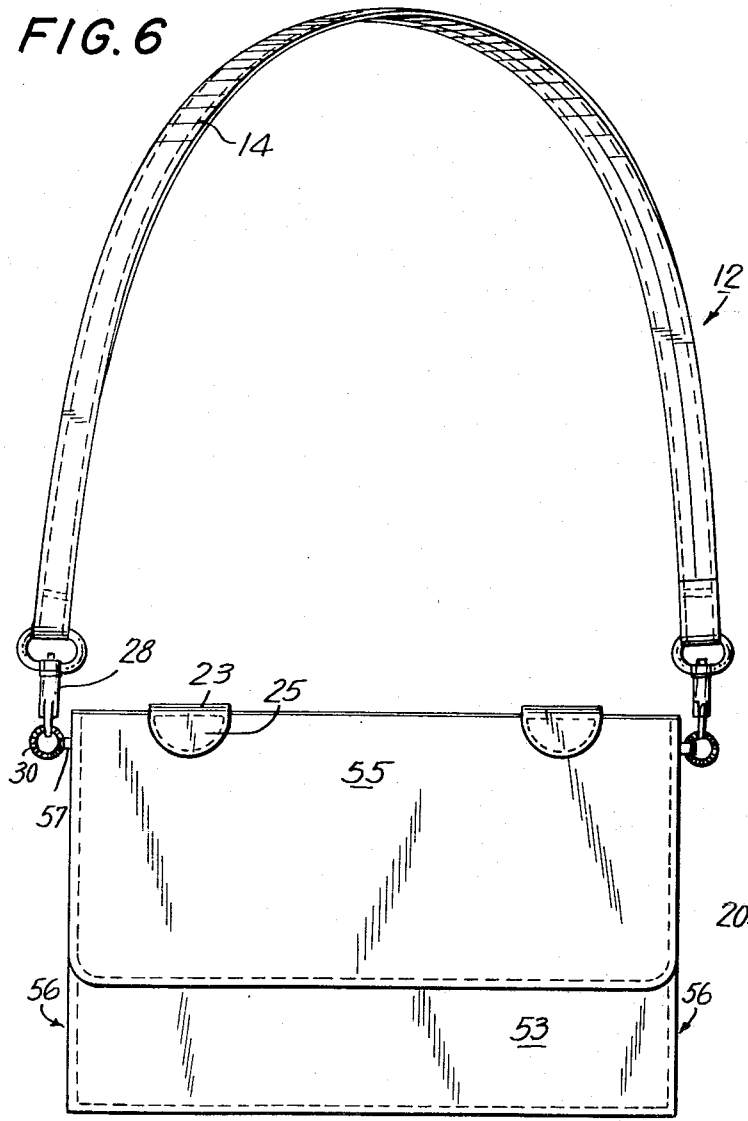
FIG. 6 is a front elevation view of the handbag separated from the attache case combination of FIG. 1.

As shown in FIGS. 1, 6 and 7, shoulder strap 14 has at its opposite ends, spring-release fasteners 28 which are optionally connectible to the first pair of support rings 29 at the top of the attache case or the second pair of support rings 30 at the side of the handbag. As shown each fastener 28 is a closed-loop element that is openable against a spring for engaging one of the rings 29. Obviously when the strap is connected and utilized, the handbag 12 becomes a shoulderbag, or the traditional attache case becomes a shoulder attache case. The locations of the support rings are logically selected to allow for connection of the shoulder strap without interference to free access into the bag or case, and to maintain aesthetic balance in proportion to the length, height and style of these luggage items.

The actual construction of the attache case in its preferred embodiment illustrated in the Figures of this application is simple, yet efficient and attractive. As shown herein, the basic structural material is high quality well-finished leather; however, obviously a variety of other materials including vinyl and fabric could be substituted. The basic front wall is two-ply, comprising the outer sheet 15 and an inner lining 15A; similarly, the rear wall is formed of outer sheet 30 and its inner liner 30A. For defining the end and bottom walls, there is left end gusset 31, right end gusset 32 and bottom gusset 33. Within the attache case, there is a rear partition 34 which has its bottom edge and opposite end edges sewn to the rear wall 30. This partition 34 is also sewn at two laterally-spaced areas 35 and 36 to the rear wall's inner liner 30A for defining medium-sized inner pockets 37 and 38 and small pen pocket 39.

A second or front partition 40 is sewn along its bottom edge and opposite ends to corresponding parts of the front wall 15/15A, thereby defining a large inner pocket 41.

Figure 5:
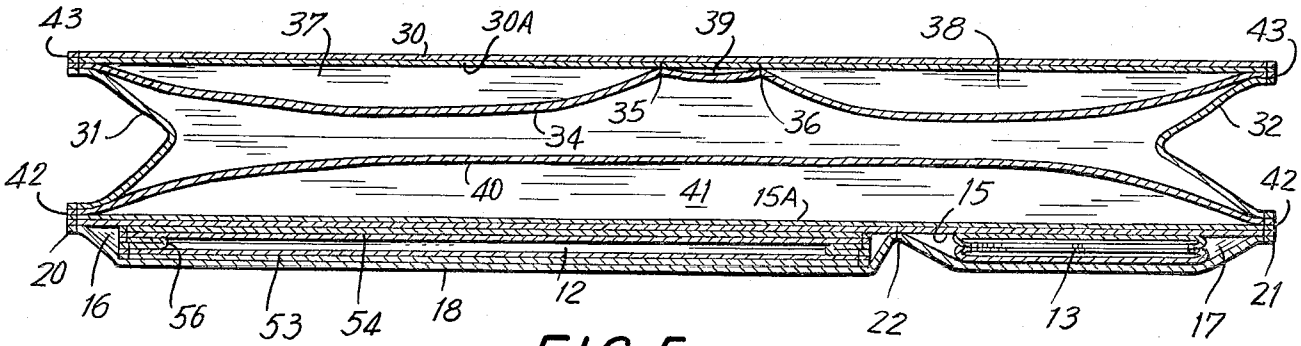
FIG. 5 is a sectional view taken along line 5—5 of FIG. 1.
Figure 4:
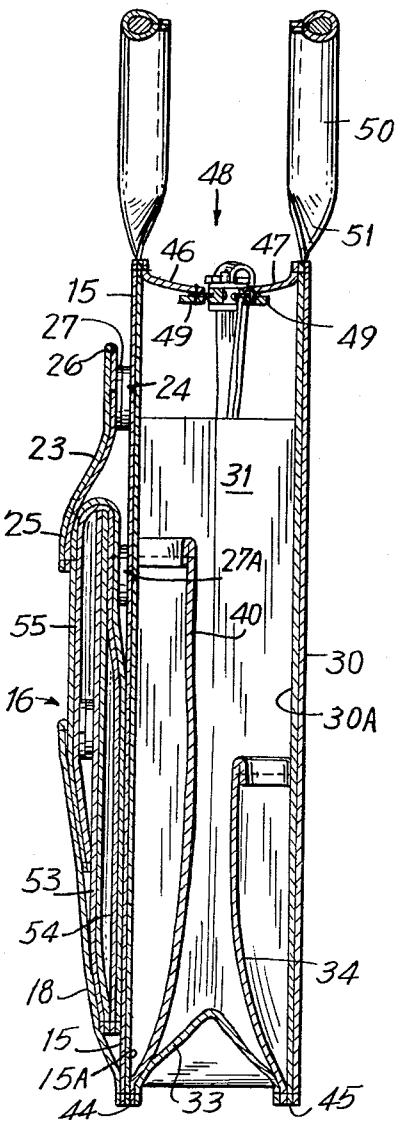
FIG. 4 is a sectional view taken along line 4—4 of FIG. 1.

In the construction of these components, standard sewing or leather stitching techniques and apparatus may be used for joining together various adjacent or abutted edges such as front and rear vertical junctions 42 and 43 respectively, seen in FIG. 5, and front and rear horizontal junctions 44 and 45 respectively, seen in FIG. 4. Forming the top of the attache case are strips 46 and 47 sewn to the front and rear walls 15 and 30 respectively, with a zipper 48 and its support strip 49 sewn to the exposed edges of strips 46 and 47. Adjacent the zipper are a pair of handles 50 secured by foot portions 51 to the upper edges of the front and rear walls. Also attached to these upper edges is the previously mentioned first pair of support rings 29 via the thin strips 52. To enhance balance of the attache case when the shoulder strap 14 is connected to the rings 29, these rings are located so that one is on the front wall 15 and the other is on the rear wall 30.

Figure 8:
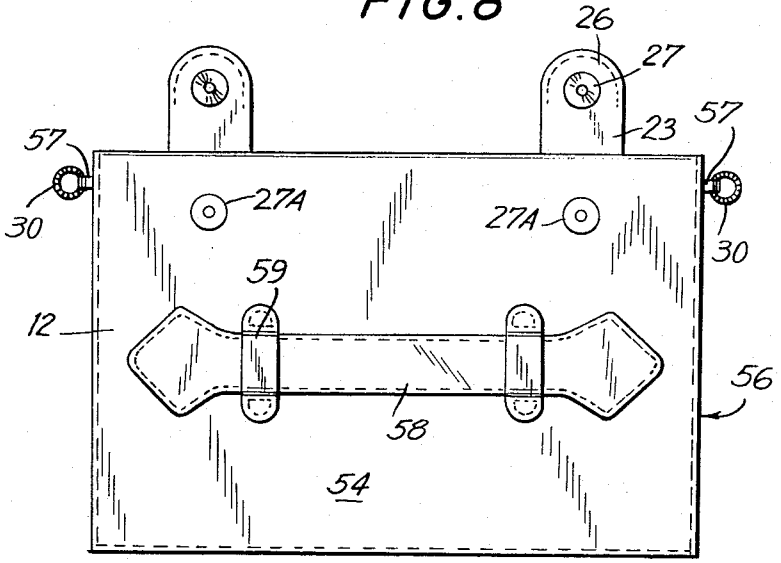
FIG. 8 is a rear elevation view of the handbag/shoulderbag of FIGS. 1 and 6.

The handbag 12 has been designed to cooperate structurally and functionally with or independently of the attache case, while also being aesthetically pleasing. Accordingly this handbag is constructed of front and rear panels 53 and 54 respectively and front flap 55 extending from the rear panel. Gusset side panels 56 as seen in FIG. 5 and indicated in FIG. 6 are sewn between the opposite end edges of the front and rear panels 53 and 54 respectively. Each of the second pair of support rings 30 is secured by a strap 57 sewn between adjacent edges of a side panel 56 and rear panel 54 as indicated in FIGS. 1, 6, and 8.

Another feature of the handbag/shoulderbag 12 is the decorative optional handle 58 situated on the rear panel 54 and secured by loops 59 sewn to this rear panel or optional slits formed in the rear panel. This handle 58 is slightly slidable within the loops, but the handle cannot be removed from the bag because its arrowhead ends are larger than the diameter of the loops.

The fourth component of this combination attache case is the optional eyeglass case or pouch 13. This pouch is dimensioned to fit easily but snugly in pocket 17 of the attache case. For security from loss or theft, the pouch is releasably joined to the attache case by the chain 60 fixed at one end to the zipper support strip 49 and provided at its remote end with a spring-release fastener 61 connectible to the zipper tab 62 of the zipper 63 situated at the top of the pouch. As shown, this pouch is constructed essentially of front and rear panels joined at their side and bottom edges; however, a variety of other forms of construction are obviously possible, including riveting and gluing.

As described above, the various sub-combination constructions of hand and shoulder luggage are possible by use of numerous releasable fasteners or coupling means. For convenience and better understanding of the structures referred to in the claims, these coupling means will be referred to as "first coupling means" at the ends of the shoulder strap, "second coupling means" formed as a pair situated on the attache case and releasably engagable with the first coupling means, "third coupling means" extendable from the handbag and releasably engagable to "fourth coupling means" on the front surface of the attache case, and "fifth coupling means" similar to the fourth and situated on the handbag for releasable engagement with the third coupling means when the handbag is removed from the attache case pocket. Finally, there is a second pair of second coupling means on the handbag releasably engagable by said first coupling means when the shoulder strap is connected to the handbag.

It should be understood that the foregoing disclosure relates to only the preferred embodiment of this invention and that numerous modifications or alterations may be made therein without departing from the spirit or scope of the invention as set forth in the appended claims.

I claim:

1. A combination attache case comprising: (a) a shoulder strap having opposite ends and releasable first coupling means at each of said ends, (b) an attache case comprising an upper part, a front wall including an outer front surface thereof with a pocket therein, a rear wall, handle means extending from said upper part, and a first pair of second coupling means located on said upper part of said attache case, each of said second coupling means adapted for releasable engagement with one of said first coupling means, and (c) a handbag comprising a front panel, a rear panel including an outer rear surface thereof and a third coupling means extendable from said handbag, said combination further comprising fourth coupling means located on said front surface of said attache case and adapted for releasable engagement with said third coupling means, fifth coupling means situated on said rear panel of said handbag, and second pair of said second coupling means also situated on said handbag, whereby said first coupling means on said shoulder strap is releasably engagable selectively to said first or said second pair of second coupling means for converting said attache case or said handbag into a shoulder attache case or a shoulderbag respectively, and said handbag is insertable into said pocket of said attache case at which time said third coupling means is releasably engagable to said fourth coupling means for securing said handbag in said pocket, and said third coupling means is also releasably engagable to said fifth coupling means when said handbag is removed from said pocket.

2. A combination according to claim 1 wherein said handbag further comprises a front flap with an upper part, and said third coupling means comprises at least one foldable tab having a lower end secured to said upper part of the front flap and an upper end movable between a first position extending upward above said handbag and a second position folded to lie against said rear panel of said handbag, said upper end comprising one member of a snap fastener, said fourth coupling means on said attache case being a mating member of said snap fastener, and said fifth coupling means being essentially the same as said fourth coupling means.

3. A combination according to claim 1 wherein said front wall of the attache case has opposite ends which define therebetween a length dimension, and top and bottom edges which define therebetween a height dimension, said attache case further comprises a strip having opposite ends and a bottom edge overlying and secured to said opposite ends and bottom edge respectively of said front wall, said strip further comprising height less than that of said front wall, and a top edge generally unattached to said front wall, thereby defining said pocket which is open at the top for receiving said handbag.

4. A combination case set comprising; a first case having pocket member affixed to one surface of said case, a second case, smaller than said first case and partially insertable into said pocket, a first coupling means on said one surface of said first case and a second coupling means affixed to said second case whereby said second case is secured by being coupled to said first case through said first and second coupling means when positioned in said pocket, and a third coupling means, affixed to said second case and matable with said second coupling means when said second case is removed from said first case to inhibit free movement of said second coupling means.

5. The combination case set forth in claim 4, wherein said second case has a detachable holding means and said second case has means for being secured to said holding means so that either said first case or said second case can be secured to said holding means.

6. A combination according to claim 5 wherein said first case includes an upper part with opposite ends defining therebetween a length dimension of said first case, handle means located generally midlength of said upper part, and said holding means securable on said first case to a pair of coupling elements located outwardly of said handle means in the direction of said ends of said upper part respectively, and to a further pair of coupling elements on said second case.

7. The case set of claim 4 wherein said second coupling means is secured to a flap, said flap being securable through said second coupling means to said first coupling means on said first case when said second case is in said pocket, or to said third coupling means on said second case when said second case is not in said pocket.

8. A combination according to claim 7 wherein said second case comprises an upper part that has opposite ends and defines therebetween a length dimension of said second case, and each of said further coupling elements is located on an opposite end of said second case.

9. A combination according to claim 7 wherein each of said coupling elements comprises a ring element and said holding means includes a closed-loop shaped element that is spring-biased to remain closed, but is openable for engaging either of said coupling elements.

10. A combination case set comprising a first case having a front wall with opposite ends which define therebetween a length dimension, and top and bottom edges which define therebetween a height dimension, said first case further comprises a strip having opposite ends and a bottom edge overlying and secured to said opposite ends and bottom edge respectively of said front wall, said strip further comprising height less than that of said front wall, and a top edge generally unattached to said front wall, thereby defining a pocket which is open at the top for receiving a second case having a thickness and length not exceeding the width and length capacity of said strip and being insertable over a substantial portion of itself into said pocket, said second case supportable along the entire bottom length thereof and a substantial portion of both sides thereof within said strip, a first detachable linking means on said first case, a second detachable linking means on said second case, and a detachable handle matable to either said first or said second linking means for independently carrying either said first case or said second case.

* * * * *

UNITED STATES PATENT AND TRADEMARK OFFICE

CERTIFICATE OF CORRECTION

PATENT NO. : 4,257,463

DATED : March 24, 1981

INVENTOR(S) : COMBINATION CARRYING CASES

It is certified that error appears in the above-identified patent and that said Letters Patent are hereby corrected as shown below:

Column 6, lines 26 and 32, change "7" to --6--.

Signed and Sealed this

*Twelfth* Day of *March 1985*

[SEAL]

*Attest:*

DONALD J. QUIGG

*Attesting Officer* *Acting Commissioner of Patents and Trademarks*